US005557294A

United States Patent [19]

Leslie

[11] Patent Number: 5,557,294

[45] Date of Patent: Sep. 17, 1996

[54] EMERGENCY SIGNAL DEVICE

[76] Inventor: William M. Leslie, 5623 Stresemann St., San Diego, Calif. 92122

[21] Appl. No.: 810,106

[22] Filed: Dec. 19, 1991

[51] Int. Cl.[6] ..... G09G 3/00

[52] U.S. Cl. ..... 345/32; 345/211; 340/815.4

[58] Field of Search ..... 310/338, 339; 340/815.21, 815.22, 573, 384.6, 815.4, 815.43, 815.49, 815.5, 815.52, 815.65, 815.66; 345/32, 48, 211

[56] References Cited

U.S. PATENT DOCUMENTS

| | | | |
|---|---|---|---|
| 2,268,476 | 12/1941 | Duncan | 340/815.21 |
| 2,317,713 | 4/1943 | Aufiero | 340/815.21 |
| 3,558,903 | 1/1971 | Yamano | 310/339 |
| 3,665,446 | 5/1972 | Burm et al. | 340/815.21 |
| 3,808,418 | 4/1974 | Conard et al. | 310/339 |
| 4,156,825 | 5/1979 | Kondo et al. | 310/339 |
| 4,171,811 | 10/1979 | Meyer et al. | 446/405 |
| 4,241,332 | 12/1980 | Farque | 340/815.22 |
| 4,282,681 | 8/1981 | McCaslin | 446/397 |
| 4,523,261 | 6/1985 | West | 310/339 |
| 4,644,328 | 2/1987 | Szymansky et al. | 340/573 |
| 4,743,028 | 5/1988 | Harrison | 340/573 |
| 4,853,580 | 8/1989 | Sula | 310/339 |
| 4,904,222 | 2/1990 | Gastgeb et al. | 446/405 |
| 5,065,067 | 11/1991 | Todd et al. | 310/339 |
| 5,132,659 | 7/1992 | Kuo | 340/815.21 |

*Primary Examiner*—Richard Hjerpe
*Assistant Examiner*—Regina Liang

[57] ABSTRACT

A new life saving device used as an emergency signal consisting of a light weight, shirt pocket size, hand powered source of bright, flashing light and high pitched sound which, when carried by persons who become injured, overboard, lost, travelers in an accident, will greatly enhance efforts to rescue them in daytime and avoid the common practice of abandoning search after dark. The light weight and small size are achieved by combining in one device a piezoelectric (ref. Cady) element and a xenon type flash tube principle, but in both derivations and developments somewhat different. The mechanics of hand operation are designed to require minimum hand effort and to obtain good reliability. One piece case adds to reliability. Change of light color at intervals aids recognition as a distress signal. The size, weight and short life of batteries are avoided, as they are not used in this invention.

3 Claims, 1 Drawing Sheet

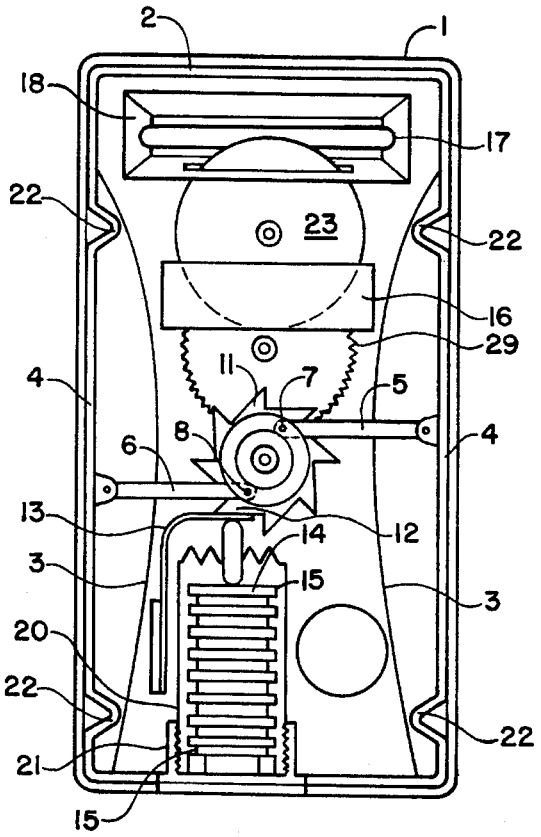
FIGURE 1
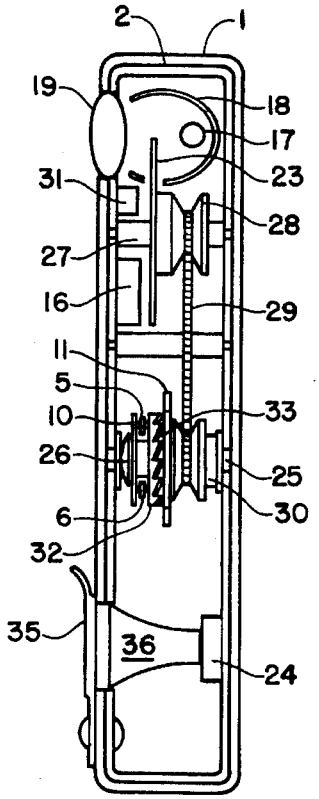
FIGURE 2
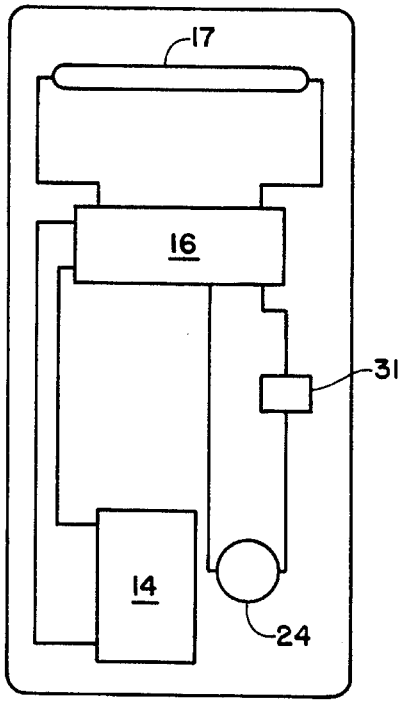
FIGURE 3
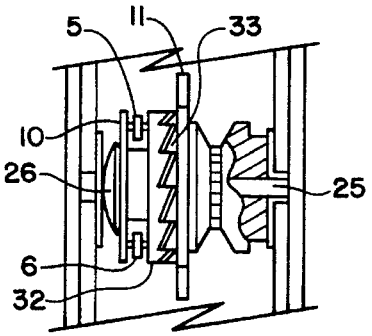
FIGURE 4
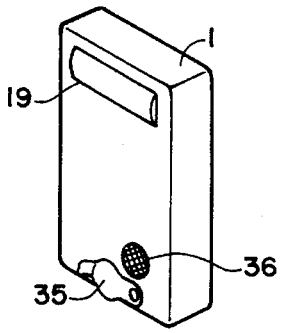

EMERGENCY SIGNAL DEVICE

A new life saving device used as an emergency signal, carried by travelers in case of accident, and by hunters, fishermen, hikers, scout troops, climbers, boaters, armed forces or people going into remote areas, who may become injured, overboard, lost, or boat disabled, plane forced down, where efforts to find and rescue such people are greatly enhanced by an intensely bright, flashing multicolored light and a high pitched burst of sound to indicate an emergency and to show exact direction, not possible with radio, to locate such people, avoiding the common practice of abandoning search after dark and starting next day, which has many times been too late.

A primary object of this invention is to provide thorough and complete research into the development of the aforesaid signal device to obtain the finest engineering design, best available materials and meticulous assembly and inspection, realizing that one or many lives may depend upon certain and positive operation, when called upon in an emergency, even after long periods of non-use.

Another object of this invention is to provide a device having all components contained in a sealed, compressible, waterproof case of such small dimensions and light weight that it can be carried in a shirt pocket and for that reason, convenience, will be on hand when needed.

Another object of this invention is to provide as source of light a xenon or similar gas filled flash tube combined with optics to concentrate such brilliant flash of light into a narrow intense beam visible from great distances.

Still another object of this invention is to provide an intense, high pitched sound, added to aforesaid flashing light as an emergency signal, employing a quartz resonator for efficient use of electrical energy.

Another object of this invention is to provide aforesaid device with means to change color of a portion of said light beam, at intervals, to distinguish said beam from other lights, as viewed by rescuers.

Another object of this invention is to provide means to change pitch of sound at intervals, to coincide with said change of colors to aid in recognition that light and sound are from same source and are distress signals.

Another object of this invention is to provide means whereby squeezing aforesaid waterproof case produces desired bright flashes and high pitched sounds.

Still another object of this invention is to develop alternative components to provide essential electrical energy, such as primary and secondary cells but in this invention both cell terminals are disconnected until aforesaid compressible case is squeezed thereby reducing off-load leakage across load circuits; secondary cells with lightweight diode charger; electromagnetic induction elements of straight line or rotary type. But preferred, for this invention, piezoelectric cells, consisting of one or more quartz crystals, wherein means are provided to press, bend and release said quartz crystals, producing electrical energy to operate said emergency signal device.

Another object of this invention is to provide mechanical means to convert manual squeezing of said case into smooth rotary motion, by inward bending of flat springs, thus moving push rods inward from opposite sides, pressing on pivot pins located above and below center of a ratchet wheel, causing said ratchet wheel and a cog wheel to turn, cog surface applying pressure and bending one or more quartz crystals, said pressure increasing as cog wheel turns to end of cog surface, abruptly relieving pressure on quartz crystals, wherein occurs a phenomenon of certain properly prepared quartz crystals, an electrical charge appears at terminals of quartz crystals, thence one or more charges through electronic circuits, one such circuit designed to match electrical characteristics of quartz crystals to requirements of aforesaid gas filled tube, another circuit designed to match said charge to characteristics of sound generator, producing desired light and sound.

Still another object of this invention is to provide an adjustable, hand strap, attached to top and bottom of case and to fit over back of user's hand to provide firm grip.

Still another object of this invention is to provide an arm length, stout cord attached to case, other end to a strong clamp for attachment to clothing, to retrieve aforesaid signal device if dropped.

These together with other objects and advantages which will become subsequently apparent reside in the details of construction and operation as more fully hereinafter described and claimed, reference being had to accompanying drawing forming a part hereof, wherein like numerals refer to like parts throughout, and in which:

FIG. 1 is a view of the device with front cover removed, showing outer pliable, waterproof case 1, enclosing all parts inner case 2 or frame, to which all parts are securely attached, front and back of inner case cut away 3 on both sides 3 to permit squeezing of outer case 1, with a hand grip, bending left and right sides of inner case 2, which sides consist of flat springs 4, such bending moves rods 5&6 horizontally toward center of case, rods 5&6 moving pins 7&8 which pins are located above and below center point of ratchet wheel 10 causing ratchet wheel 10 and cogwheel 11 to turn together a distance of one cog 12; moving one cog 12 across top of pressure spring 13 compressing one or more quartz crystals 14 when end of cog 12 is reached, pressure spring 13 is released, abruptly relieving pressure on one or more quartz crystals 14, causing an electric charge to appear at crystal terminals 15.

One or more charges are diverted through electronic elements 16 to terminals of flash tube 17 and to terminals of sound generator 24, causing xenon tube 17 to flash and sound generator 24 to produce desired sound.

As hand grip is released, cog wheel 11 tends to reverse rotation, but is blocked by pressure spring 13; but ratchet wheel 10, push rods 5&6 and flat springs 4 can return to original position by action of ratchet elements 32&33 which are machined or molded on adjacent sides of ratchet wheel 10 and cog wheel 11 as indicated in FIG.2 and enlarged in FIG.4

Light from flash tube 17 is concentrated by reflector 18 and lens 19 causing an intense beam of light to be projected from case 1.

Light from flash tube 17 is partially intercepted at intervals by a segmented multicolor disk 23, which rotates through gears 28, 29, 30 by means of cogwheel 11.

Disk 23 and switch 31 are mounted on one sleeve 27 which fits closely around shaft 9. Shaft 9 and shaft 25 are welded to, or securely attached to, or a part of inner case 2 at both ends. Spring washer 26, ratchet wheel 10, cogwheel 11 and gear 28 all revolve on shaft 25 but are not attached to it.

One or more quartz crystals 14 are enclosed in threaded container 20, threads on container 20 mesh with threads on container mount 21. Container 20 and terminals cannot rotate on its axis but container mount 21 can be turned with a tool to adjust pressure on one or more quartz crystals 14 to obtain maximum electrical output.

Air passage 36 to sound generator 24, is sealed with cover 35 to keep air passage 36 clean when not in use but cover 35 can be quickly removed. Sound unit 24 is sealed internally so that with cover 35 removed, moisture cannot enter case 1 or case 2.

FIG. 3 represents a wiring harness, starting at crystal terminals 15, thence to electronic elements 16, from 16, pairs of wires to flash tube 17, sound generator 24, and switch 31.

Having thus completely and fully described the invention, what is now claimed as new is as follows:

1. An emergency signal device comprising in combination, a) a xenon or other gas filled flash tube for emitting bright flashes of light, b) a reflector and a lens for projecting said bright flashes of light in narrow intense beams such that the distance of visibility is multiplied so as to provide an indication over long distances, c) a compressible water proof case for housing said device, d) a segmented multicolor disk between said flash tube and said lens for changing the color of emitted light, wherein squeezing of said case results in rotation of said segmented multicolor disk and supplies power to said flash tube such that bright flashes of different colors of light are emitted over long distances.

2. A device as recited in claim 1, further comprising a sound generator for producing high pitched sound upon squeezing of said case, wherein the pitch of said sound changes automatically at intervals.

3. A device as recited in claim 1, further comprising means for producing said power by a magnetic generator, alternate means for producing said power by a piezoelectric generator, and alternate means for producing said power by primary or secondary cells employing a pressure switch.

* * * * *